US005308977A

United States Patent [19]

Oishi et al.

[11] Patent Number: 5,308,977

[45] Date of Patent: May 3, 1994

[54] PLASMA MASS SPECTROMETER

[75] Inventors: Konosuke Oishi, Mito; Masataka Koga, Katsuta; Hiromi Yamashita, Katsuta; Takashi Iino, Katsuta; Toyoharu Okumoto, Katsuta; Tsuyoshi Nishitarumizu, Katsuta, all of Japan

[73] Assignee: Hitachi, Ltd, Tokyo, Japan

[21] Appl. No.: 25,139

[22] Filed: Mar. 2, 1993

[30] Foreign Application Priority Data

Mar. 4, 1992 [JP] Japan ..... 4-46648

[51] Int. Cl.[5] ..... H01J 49/36

[52] U.S. Cl. ..... 250/288; 250/281; 250/423 R; 315/111.21

[58] Field of Search ..... 250/288, 288 A, 281, 250/282, 423 R, 425, 426, 496.1, 505.1; 315/111.21, 111.41, 111.51, 111.71, 111.81, 111.91, 112; 313/231.31, 231.41, 231.51

[56] References Cited

U.S. PATENT DOCUMENTS 4,804,838 2/1989 Miseki ..... 250/288

5,086,255 2/1992 Okamoto et al. ..... 315/111.21

OTHER PUBLICATIONS

Tan et al. "Background Spectral Features in Inductively Coupled Plasma/Mass Spectrometry" vol. 40, No. 4, 1986, pp. 445-460.

Tsukahara et al. "Studies with desolvation in inductively coupled plasma-mass spectrometry" vol. 45B, No. 6, Jul., 1989, pp. 581-589.

Shen et al. "A Moderate-Powder Nitrogen Microwave-Induced Plasma as an Alternative Ion Source for Mass Spectrometry", vol. 44, No. 6, 1990, pp. 1003-1010.

Okamoto "Annular-shaped Microwave-Induced Nitrogen Plasma at Atmospheric Pressure for Emission Spectrometry of Solutions" Analytical Sciences, Apr., 1991, pp. 283-288.

Shen et al. "Background Spectral Features for Moderate-Power Nitrogen Microwave-Induced Plasma-Mass Spectrometry" vol. 44, No. 6, 1990, pp. 1017-1014.

*Primary Examiner*—Paul M. Dzierzynski

*Assistant Examiner*—Kiet T. Nguyen

*Attorney, Agent, or Firm*—Antonelli, Terry, Stout & Kraus

[57] ABSTRACT

A plasma mass spectrometer generates an aerosol of a sample, by dissolving the sample in a liquid solvent, and spraying the liquid into a spray chamber via a nebulizer. The solvent condenses in the spray chamber and an aerosol of the sample then passes through a supply tube to a plasma torch. Microwave power from an output on the plasma torch converts the aerosol to a plasma, and the plasma passes to an analyzer. If microwave radiation reached the spray chamber, it would cause heating of the solvent which may evaporate it so that the solvent would be present in the plasma. Therefore, there is a wall between the spray chamber and the plasma torch and microwave output which blocks such microwave radiation.

10 Claims, 2 Drawing Sheets

PLASMA MASS SPECTROMETER

BACKGROUND OF THE INVENTION

The present invention relates to a plasma mass spectrometer. In such a spectrometer, a plasma containing the sample material is generated by a plasma torch, and is passed to a mass analyzer.

In a plasma mass spectrometer, the plasma is generated by the application of high frequency power to an aerosol of the sample material. That aerosol is generated by spraying a solution of solvent containing the sample material from a nebulizer into a spray chamber. The solvent is removed from the aerosol by condensation in the spray chamber, and the sample material is passed to the plasma torch. In the plasma torch, the sample is converted to a plasma by high frequency power. A gas is also supplied to the plasma torch.

The most common form of such a plasma mass spectrometer makes use of radio frequency power. The power is supplied to a coil surrounding the plasma torch, and the power is inductively transferred to the plasma. Such an arrangement is known as inductively coupled plasma (ICP) mass spectrometry. The radio frequency power may have a frequency of 10 to 100 MHz and typical values used are in the range 27–40 MHz. With an inductively coupled plasma spectrometer, it is necessary to supply an inert gas to the plasma torch, and that inert gas is normally argon (Ar).

A disadvantage of such a plasma mass spectrometer is that the measurement of a sample may be affected by the presence in the plasma of ions other than those of the sample. The influence of such ions is referred to as a background spectrum, or interference. It is thus important that the interference is minimized.

Interference in an inductively coupled plasma mass spectrometer is described, for example, in the article entitled "Background Spectal of Features in Inductively Coupled Plasma/Mass Spectrometry" by S. H. Tan and G. H. Horlick in Applied Spectroscopy, Vol. 40, No. 4, 1986, pages 445–460, and the article entitled "Studies with Desolvation in Inductively Coupled Plasma-Mass Spectrometry" by R. T. Tsukahara and M. K. Kubota in . . . pages 581 to 589. In particular, it is found that the use of argon as the inert gas supplied to the plasma torch causes the disadvantage that the interference caused by the argon renders difficult or impossible the measurement of certain ions. Thus, as is evident from the article by S. H. Tan et al, the use of argon may render impossible measurements on calcium (CA), Iron (Fe) or chromium (Cr).

Therefore, proposals have been made to make use of microwave frequency power. Microwave frequency power generally has a higher frequency, e.g. greater than 100 MHz, than radio frequency power, and typical proposals have been of the order of 2.45 GHz. The use of such microwave frequency power has the advantage that the gas to be supplied to the plasma torch is not limited to an inert gas, and nitrogen, oxygen, or even air can be used. Of course, an inert gas such as Argon can also be used. The use of such microwave frequency power is known as microwave induced plasma (MIP) mass spectrometry.

Examples of such spectrometry are disclosed in an article entitled "A Moderate-Power Nitrogen Microwave-Induced Plasma as an Alternative Ion Source for Mass Spectrometry" by W. L. Shen et al in Applied Spectroscopy, and Vol. 44, No. 6, 1990, pages 1003–1010, the article entitled "Annular-Shaped Microwave-Induced Nitrogen Plasma at Atmospheric Pressure for Emission Spectrometry of Solutions" by Y. Okamoto in Analytical Sciences, April 1991, Vol. 7, pages 2382–88. The interference which then occurs is disclosed in, for example, the article entitled "Background Spectral Features for Moderate-Power Nitrogen Microwave-Induced Plasma Mass Spectrometry" by W. L. Shen et al in Applied Spectroscopy, Vol. 44, No. 6, 1990, pages 1011–1014.

SUMMARY OF THE INVENTION

The present invention is concerned with microwave-induced plasma mass spectrometry. The applicants have investigated such mass spectrometry and have appreciated that a problem develops, which problem has not previously been appreciated.

In a plasma mass spectrometer, the plasma of the sample is normally generated by supplying the sample to the plasma torch in aerosol form. That aerosol is generated by suitable generating means. Typically, the sample is dissolved in a solvent, and the solvent is sprayed into a spray chamber, forming the generation means, from a nebulizer. The solvent condenses in the spray chamber, and thus an aerosol of the sample can be extracted from the spray chamber. The solvent drains to a suitable reservoir.

Normally, the spray chamber forming the aerosol generating means is close to the plasma torch, and is connected thereto by a relatively short supply tube. It is normally important to keep the separation of the spray chamber and the plasma torch relatively small, so that the aerosol of the sample does not adhere to the supply tube.

However, the spray chamber forming the generating means is then exposed to microwave radiation from the output of microwave power to the plasma torch. Although that microwave power is supplied to the plasma torch in order to generate the plasma of the sample, some microwave power is emitted, which radiates outwardly, and that radiated microwave power may propagate to the spray chamber.

The applicants have found that this then causes heating of the solvent. That heating may be sufficient to evaporate the solvent within the spray chamber. Then, solvent material may pass with the aerosol to the plasma torch, and be included in the plasma passed to the analyzer, thereby causing interference.

Although such heating may occur with radio frequency power, the heating effect is significantly less than with microwave power and thus the disadvantageous effect of the use of microwave power has not previously been appreciated.

Therefore, the present invention proposes that the aerosol generating means be shielded from the output of the microwave power to the plasma torch.

At its simplest, that shielding may be a wall between the generating means (for example, a spray chamber) and the microwave power output to the plasma torch. The material of the wall is then chosen in order to block microwave radiation. For example, a metal, such as aluminum or steel is suitable.

It is possible for there to be openings in such a wall, provided those openings are sufficiently small. Microwave radiation will not propagate through a hole whose diameter is less than a value with a fixed relationship to the frequency. Therefore, openings in the wall having a diameter suitably small are possible.

Preferably, the diameter D of such openings is given by:

$$D \leqq \frac{\lambda_c}{A\sqrt{\epsilon_R}}$$

where: $\lambda_c$ is the wavelength of the microwave frequency power;

$\epsilon_R$ is the specific dielectric constant of the medium between the microwave cavity and the spray chamber; and A is a constant.

A is preferably 1.7.

Such an opening permits a supply tube to extend through the wall from the generating means to the plasma torch, for the passage of the sample aerosol therebetween. Provided the diameter of that supply tube is small, the microwave power will not propagate down it.

The wall forming the shielding may be a wall of a casing surrounding the plasma torch and the microwave power output to the plasma torch. Such a casing also has the advantage of blocking microwave radiation in other directions, e.g. to protect the operator. Indeed, it is known to provide a casing around the plasma torch, but such a casing has previously contained within it the generating means. Thus, in the present invention either the generating means is located outside such a casing, or such a casing has an internal wall between the generating means and the plasma torch.

Although it is possible to provide a microwave generator immediately proximate the plasma torch, it is preferable for there to be a microwave cavity proximate the torch, which cavity thus forms the microwave output. That cavity receives microwaves from a microwave source, which it is connected via a suitable wave guide.

BRIEF DESCRIPTION OF THE DRAWINGS

Embodiments of the present invention will now be described in detail, by way of example, with reference to the accompanying drawings, in which.

DETAILED DESCRIPTION

Figure 1:
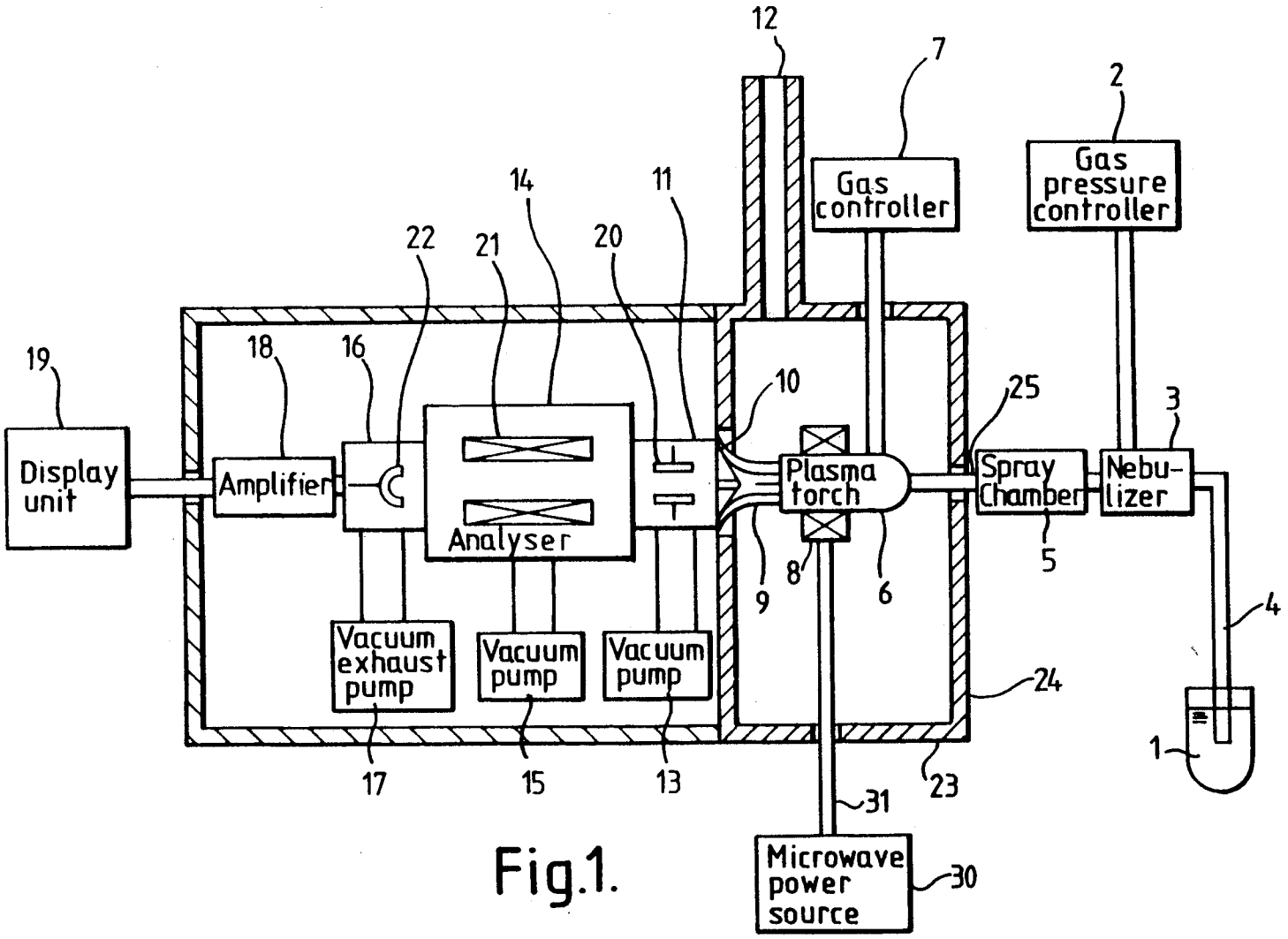
FIG. 1 shows a plasma mass spectrometer forming a first embodiment of the present invention.

A first embodiment of the present invention will now be described with reference to FIG. 1, which shows a mass spectrometer using a plasma as an ion source, which plasma is generated by microwave power.

A sample for analysis is dissolved in a solvent, such as water, and is contained in a vessel 1. A gas acting as a carrier gas is supplied from a gas pressure controller 2. The sample, together with the solvent, is mixed with the carrier gas in a nebulizer 3, passes through a capillary 4 and is sprayed into a spray chamber 5 to form a spray (aerosol). The solvent tends to form relatively large-size droplets within the aerosol. Such particles condense into droplets, some of which become attached to the inner wall of spray chamber 5, which spray chamber 5 may be made of glass. The sample forms relatively small-size droplets in the aerosol, and such droplets pass into a plasma torch 6. The detailed structure of the nebulizer 3, the spray chamber 5, and the plasma torch may be conventional and will not be described in further detail.

A further gas, such as nitrogen (16l/min.), is supplied as a discharge gas into the plasma torch 6 from a gas controller 7. The plasma torch 6 has attached thereto a microwave cavity 8. The microwave cavity 8 is connected to a microwave power source 30 via a suitable waveguide 31. Thus, the microwave cavity 8 acts as an output of microwave power to the plasma torch 6. The microwave cavity 8 may be such as disclosed in e.g. the article by Y Okamoto referred to previously and will not be described in detail. However, it is important to note that not all the microwave power will be absorbed during the generation of the plasma, and hence microwaves will radiate outwardly from the microwave power source 8 and the plasma torch 6.

When microwave frequency power (for example 1.2 watts at a frequency of 2.45 GHz) is supplied, a plasma 9 is generated by microwave inductive coupling. The ions of the plasma 9 are sucked into an interface part 11 of the mass analyzer via a sampling cone 10 having a small hole of 1.0 mm in diameter at its tip. Again, these components may be conventional.

The inactive gas which does not pass the sampling cone 10 is discharged to the exterior through a duct 12. Gas is extracted from the interface part 11 of the mass spectrometer by a vacuum pump 13 and the pressure is maintained at about 130 Pa (1 Torr). A lens 20 to converge the ions is provided inside the interface part 11. Gas is extracted by a vacuum pump 15 from an analyzing part 14 which accommodates an analyzer, such as a quadruple mass analyzer 21, and the pressure is maintained at about $10^{-4}$ Pa. Ions of the element or elements of the sample to be analyzed are converted into an electric signal by an ion detector 22, and the signal is input to a display unit 19 through an amplifier 18.

Ions corresponding to the mass number (m/z) of the element of the sample to be analyzed are selected by the quadruple mass analyzer 21, and a mass spectrum may thus be displayed on display unit 19. The intensity of the mass spectrum of the ions of the element of the sample to be analyzed is proportional to the concentration of the element dissolved in the solvent; therefore, it is possible to obtain the concentration of the element or elements of an unknown sample by comparison with a standard sample with known concentration.

In FIG. 1, a vacuum exhaust pump 17 is used to remove gas from a detector 16 which accommodates an ion detector 22. As will be described in more detail later, the torch tube 6 and the microwave cavity 8 forming a microwave power output are located within a high frequency cutoff casing 23. A microwave frequency cutoff wall 24 of the microwave frequency cutoff casing 23 has a small hole, through which passes an aerosol supply tube 25 from the spray chamber 5. The high frequency cutoff box 23 is made of metal, and is designed to have an air-tight configuration wherever required, to minimize leakage of plasma to the exterior thereof. The microwave frequency cutoff casing 23 may have a door (not illustrated). The opening and closing of this door may also provide electric switching; when the door is open, the switch is turned off to prevent the microwave power source 30 from operating. The inner diameter of aerosol supply tube 25 should be 6 to 8 mm.

As has previously been mentioned, large droplets of the solvent sprayed from nebulizer 3 tend to fall or adhere to the inner wall of the spray chamber 5. The atomized sample, of small particle size, together with the carrier gas, will pass to the plasma torch 6 through the aerosol supply tube 25. However, if microwave power reaches the droplets of solvent on the inner wall of the spray chamber 5, those droplets would then be heated. The spray chamber 5 is normally made of glass which allows microwave radiation to propagate therethrough. Such heating could cause evaporation of the solvent droplets, which could then pass through the aerosol supply tube 25 to the plasma torch 5 and so form part of the plasma.

Therefore this embodiment proposes that a microwave frequency cutoff wall 24 be provided in the casing 23 so as to block microwave radiation propagating from the microwave cavity 8 towards the spray chamber 5, thereby shielding the spray chamber 5. Hence, droplets of solvent on the inner wall of the spray chamber 5 are not heated. As a result, the vapor pressure inside spray chamber 5 is kept constant, and the vapor introduced into the high frequency discharged plasma 9 is maintained at the lowest constant amount. Therefore, it is possible to maintain a constant intensity (ion intensity) of the detection electric signal based on the ion of the element or elements to be analyzed which have been mass-sorted by the quadruple mass analyzer 21.

It can be appreciated that the aerosol supply tube creates an opening in the microwave frequency cutoff wall 24. However, microwaves will not propagate through that opening if the opening is sufficiently small. The maximum diameter D of the opening is given by the relationship $$D \leqq \frac{\lambda_c}{A\sqrt{\epsilon_R}}$$

where: $\lambda_c$ is the wavelength of the microwave frequency power;

$\epsilon_R$ is the specific dielectric constant of the medium between the microwave cavity 8 and the spray chamber 3; and A is a constant.

A is preferably 1.7.

For microwave power with a frequency of 2.45 GHz, and assuming that there is air in the microwave frequency cutoff casing 23, D=7.2 cm. This thus imposes a maximum diameter on the aerosol supply tube.

Figure 2:
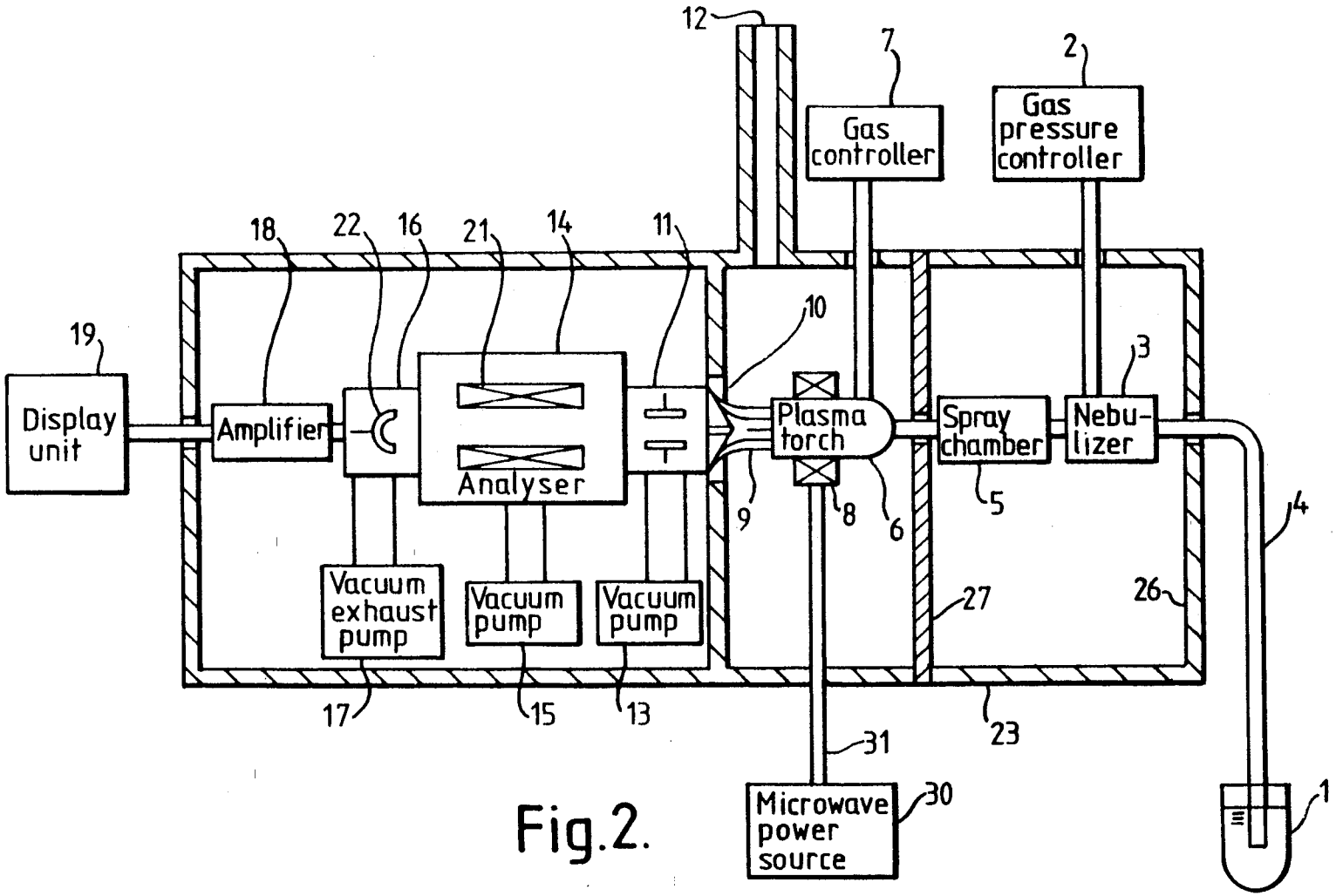
FIG. 2 shows a plasma mass spectrometer forming a second embodiment of the present invention.

FIG. 2 illustrates another embodiment of the present invention. In FIG. 2, components having the same function as the corresponding components in FIG. 1 are indicated by the same reference numerals. The difference between the plasma ion mass spectrometer shown in FIG. 2 and that shown in FIG. 1 lies in the shielding of the spray chamber 5 from microwave radiation. In the embodiment of FIG. 2, the casing 23 has an outer wall 26 enclosing the spray chamber 5 on the nebulizer and an initial wall 27. Microwave frequency power is prevented from reaching the spray chamber 5 by internal wall 27, which is between the spray chamber 5 and the plasma torch 6 and microwave cavity 8. The embodiment in FIG. 2 provides the same effects and advantages as that in FIG. 1.

When a water solution sample containing e.g. Ba, Nd and Sm is analyzed by the equipment shown in either of the embodiments described above, there is an increase in the signal amount of Ba+, Nd+1 and Sm+ (which are the ions of the elements to be analyzed), and a decrease in the amount of BaO+, NdO+1 and SmO+, (which are interference) components compared to the case when conventional equipment was used for analysis. Use of the present invention thus improves the secular stability of the ion signal of the element to be analyzed, as well as reproducibility for repeated measurements.

What is claimed is:

1. A plasma mass spectrometer comprising:

generating means for generating an aerosol of a sample;

a plasma torch for receiving the aerosol from said generating means;

microwave output means mounted in proximity to said plasma torch for supplying microwave frequency power to said plasma torch, thereby to ionize said aerosol in said plasma torch to form a plasma of ions; and means for analyzing said plasma by mass spectrometry;

wherein a shielding member is provided between said generating means and said microwave output means for shielding said generating means from microwave frequency power applied by said microwave output means to said plasma torch.

2. A plasma mass spectrometer according to claim 1, wherein said shielding member is a wall having an opening therein for passage of said aerosol from said generating means to said plasma torch, said opening having a diameter D such that $$D \leqq \frac{\lambda_c}{A\sqrt{\epsilon_R}}$$

where $\lambda_c$ is the wavelength of the high frequency power;

$\epsilon_R$ is the specific dielectric constant of the transmission medium of said microwave frequency power between said microwave output means and said generating means; and $A \approx 1.7$

3. A plasma mass spectrometer according to claim 2, having a casing around said microwave output means and said plasma torch, said wall being part of said casing.

4. A plasma mass spectrometer according to claim 1, having an aerosol supply tube extending through said shielding member from said generating means to said plasma torch.

5. A plasma mass spectrometer according to claim 1, wherein said generating means includes a nebulizer and a spray chamber.

6. A plasma mass spectrometer according to claim 1, wherein said microwave output means is a microwave cavity connected to said plasma torch, and said plasma mass spectrometer further includes a microwave source and a waveguide connecting said microwave source to said microwave cavity.

7. A plasma mass spectrometer according to claim 6, wherein said shielding member is formed in a casing which encloses said plasma torch, and wherein said microwave source is located outside said casing.

8. A plasma mass spectrometer according to claim 6, wherein said generating means, said plasma torch and said microwave cavity are enclosed in a casing, and wherein said shielding member is provided as a wall within said casing between said generating means and said microwave cavity.

9. A plasma mass spectrometer according to claim 8, wherein said microwave source is located outside said casing.

10. A plasma mass spectrometer according to claim 1, wherein said shielding member is made of metal.

* * * * *